US010317156B2

(12) United States Patent
Shaver

(10) Patent No.: US 10,317,156 B2
(45) Date of Patent: Jun. 11, 2019

(54) ERGONOMIC TAKEDOWN FIREARM APPARATUS

(71) Applicant: Vadum, Inc., Raleigh, NC (US)

(72) Inventor: Jesse Hart Shaver, Cary, NC (US)

(73) Assignee: Vadum, Inc., Raleigh, NC (US)

( * ) Notice: Subject to any disclaimer, the term of this patent is extended or adjusted under 35 U.S.C. 154(b) by 461 days.

(21) Appl. No.: 14/966,886

(22) Filed: Dec. 11, 2015

(65) Prior Publication Data

US 2017/0167812 A1 Jun. 15, 2017

(51) Int. Cl.

| | |
|---|---|
| ***F41A 11/02*** | (2006.01) |
| ***F41A 19/59*** | (2006.01) |
| ***F41C 23/04*** | (2006.01) |
| ***F41A 19/16*** | (2006.01) |

(52) U.S. Cl.

CPC ..... *F41A 11/02* (2013.01); *F41A 19/16* (2013.01); *F41A 19/59* (2013.01); *F41C 23/04* (2013.01)

(58) Field of Classification Search

CPC ..... F41A 11/02; F41A 19/58; F41A 19/69; F41A 19/70; F41A 19/63; F41A 19/68; F41A 17/06; F41A 19/59; F41A 19/61; F41A 17/063; F41A 19/18; F41A 21/484; F41A 21/485; F41A 19/16; F41C 23/04

USPC ..... 42/69.01

See application file for complete search history.

(56) References Cited

U.S. PATENT DOCUMENTS

| | | | | | |
|---|---|---|---|---|---|
| 450,448 | A * | 4/1891 | Cilley | F41A 21/482 | 42/75.02 |
| 557,360 | A * | 3/1896 | Burgess | F41A 9/18 | 42/21 |
| 618,033 | A * | 1/1899 | Hemming | F41A 21/482 | 42/49.01 |
| 1,373,888 | A * | 4/1921 | Johnson | F41A 21/482 | 42/75.02 |
| 2,337,145 | A * | 12/1943 | Albree | F41A 19/59 | 42/106 |
| 2,447,091 | A * | 8/1948 | Pope | F41A 11/00 | 42/18 |

(Continued)

*Primary Examiner* — Joshua E Freeman
*Assistant Examiner* — Bridget A Cochran
(74) *Attorney, Agent, or Firm* — Murphy, Bilak & Homiller, PLLC

(57) ABSTRACT

An example firearm with a short overall length and improved storage compactness comprises a forward takedown subassembly comprising a barrel, a trigger control mechanism configured to provide an electrical trigger control signal, and a signal transmitter electrically coupled to the trigger control mechanism, and further comprises a rearward takedown subassembly separable from the forward takedown subassembly and comprising a stock, a receiver comprising an electrically controlled firing mechanism, and a signal receiver electrically coupled to the firing mechanism. A takedown mechanism has first and second portions fixedly coupled to the forward takedown subassembly and the rearward takedown subassembly, respectively, and is configured to repeatably couple the forward takedown subassembly to the rearward takedown subassembly. The signal transmitter and the signal receiver are configured to link the electrical trigger control signal to the signal receiver output via one or more of an electrical connection, an optical connection, and a radio-frequency link.

10 Claims, 10 Drawing Sheets

(56) References Cited

U.S. PATENT DOCUMENTS

| | | | | | |
|---|---|---|---|---|---|
| 3,306,168 | A * | 2/1967 | Blumrick | F41A 3/38 | 42/75.02 |
| 3,650,174 | A * | 3/1972 | Nelsen | F41A 19/58 | 42/42.01 |
| 3,736,837 | A * | 6/1973 | Kaprelian | F41A 19/63 | 102/202.8 |
| 4,727,670 | A * | 3/1988 | Krouse | F41A 17/56 | 42/69.01 |
| 4,944,109 | A * | 7/1990 | Zedrosser | F41C 23/00 | 42/71.01 |
| 5,625,972 | A * | 5/1997 | King | F41A 19/58 | 102/472 |
| 5,713,150 | A * | 2/1998 | Ealovega | F41A 19/46 | 42/84 |
| 5,755,056 | A * | 5/1998 | Danner | F41A 3/22 | 42/84 |
| 6,250,194 | B1 * | 6/2001 | Brandl | F41A 19/18 | 42/71.01 |
| 7,841,121 | B1 * | 11/2010 | Barrett | F41A 11/04 | 42/75.02 |
| 7,966,761 | B1 * | 6/2011 | Kuczynko | F41C 23/04 | 42/73 |
| 8,615,915 | B2 * | 12/2013 | Hunter | F41A 19/10 | 42/69.01 |
| 2004/0244258 | A1 * | 12/2004 | O'Dwyer | F41A 9/35 | 42/77 |
| 2007/0091266 | A1 * | 4/2007 | Shaver | A61B 3/1005 | 351/212 |
| 2013/0239453 | A1 * | 9/2013 | Trimble | F41A 23/02 | 42/106 |
| 2014/0075803 | A1 * | 3/2014 | Muller | F41A 11/02 | 42/16 |
| 2015/0308769 | A1 * | 10/2015 | Audibert | F41A 19/10 | 42/69.01 |

* cited by examiner

ERGONOMIC TAKEDOWN FIREARM APPARATUS

TECHNICAL FIELD

The present invention generally relates to the field of firearm design, and more particularly to an ergonomic takedown firearm apparatus and method of assembly.

BACKGROUND

Many firearms are designed to satisfy requirements of compactness and ergonomics during handling and storage. Several design strategies have been used to achieve compactness for shoulder-fired firearms.

Bullpup Configuration

In the traditional design of long guns, a shoulder stock is located at the rearward end of the firearm, where the "rearward end" of the firearm is the end that is placed against the user's shoulder during use. The traditional firearm further includes a receiver, trigger control, and firing mechanism located in the mid-section near the shooter's dominant hand, with a barrel extending forward from the receiver.

One design strategy used to achieve improved compactness, relative to the traditional firearm design, is a so-called "bullpup" configuration. A bullpup configuration is one in which the receiver and firing mechanism is re-located rearward with respect to the trigger control, and incorporated into the shoulder stock volume, to achieve a shorter overall length when compared to a conventional shoulder-fired firearm with a barrel of equivalent length.

In a bullpup firearm, it is typical to locate the trigger control at a conventional location and distance from the rear surface of the shoulder stock. The distance between the rear surface of the shoulder stock and the trigger control is often termed the "length of pull" of a firearm. In order to maintain a conventional length of pull in the bullpup configuration, some means is used to connect the forward-located trigger control to the rearward-located action. Typically, this is accomplished with a mechanical linkage device consisting of one or more linkage rods, linkage cables, or levers, which transmit forces from the trigger control to the firing mechanism, for example, causing a sear to release a hammer. However, these mechanical firing linkages are associated with poor ergonomic quality of the bullpup trigger control, compared to the trigger control in traditional firearm designs, because the flexing and friction of the added linkage parts contribute to additional trigger control travel, pull force (often referred to as "weight"), roughness, creep, grit, over-travel, take-up, let-off, or other common defects in ergonomic quality of trigger controls.

Takedown Configuration

Another design strategy used to achieve compactness for storage purposes is a "takedown" firearm configuration. In a takedown firearm, a forward assembly of the firearm, typically including the barrel, can be removed from a rearward assembly, typically including the stock and receiver. A takedown firearm is typified by an expedient process to assemble and disassemble the firearm, which often requires few or no tools to accomplish. Desirable aspects of a takedown firearm design include simple operation and consistency in the point-of-impact, as indicated by the firearm's sighting system point-of-aim after disassembly and reassembly operations.

In the case of takedown firearms with sighting systems mounted wholly or partially to the rearward assembly, extreme consistency of the mechanical alignment of the forward assembly must be achieved to maintain the point-of-aim indicated by the sighting system to the projectile point-of-impact. In the case of takedown firearms with sighting systems mounted wholly to the forward assembly, this extreme consistency is not required, because mechanical alignment between the sighting system and barrel bore is maintained during takedown disassembly. One patent describing a takedown firearm is U.S. Pat. No. 7,841,121. This patent describes an optical scope sighting system with a relatively long eye relief distance, which allows the rear aspect of the optical scope to be located forward of the takedown joint location. However, for scopes with typical eye relief distances, cantilevered sighting system mounts must be used to achieve acceptable eye relief distance between the ocular lens of a typical optical sighting device and the shooter's sighting eye. These cantilevered mounts protrude from the rear of the forward assembly, increasing the length of the forward assembly. This partially diminishes the main benefit of compact storage for a takedown firearm.

Stock Configuration

Still another design strategy used to achieve overall compactness is a stock that folds, telescopes, or both folds and telescopes. In the case of firearm stocks that telescope, this feature can have an added benefit of providing adjustability in the length-of-pull to best suit a particular user. Optimal length-of-pull for a particular user may vary due to arm length, neck length, sighting system, and preferred shooting posture. One patent describing a firearm with a folding and telescoping stock is U.S. Pat. No. 7,966,761. This patent describes a folding and telescoping stock which allows the firearm to be stored and manipulated more easily in confined spaces such as vehicle cabins. Extending or collapsing the telescoping adjustment on the stock allows different shooters to accommodate for differences in arm length and clothing thickness (including heavy coats or body armor) to improve the fit of the firearm.

SUMMARY OF THE INVENTION

A method and apparatus for providing an accurate and ergonomic firearm with a short overall length and improved storage compactness is disclosed.

An example embodiment comprises a forward takedown subassembly comprising a barrel, a trigger control mechanism configured to provide an electrical trigger control signal, and a signal transmitter electrically coupled to the trigger control mechanism, and further comprises a rearward takedown subassembly separable from the forward takedown subassembly and comprising a stock, a receiver comprising an electrically controlled firing mechanism, and a signal receiver electrically coupled to the firing mechanism. A takedown mechanism has first and second portions fixedly coupled to the forward takedown subassembly and the rearward takedown subassembly, respectively, and is configured to repeatably couple the forward takedown subassembly to the rearward takedown subassembly. The signal transmitter and the signal receiver are configured to link the electrical trigger control signal to the signal receiver output via one or more of an electrical connection, an optical connection, and a radio-frequency link.

DETAILED DESCRIPTION

Figure 1:
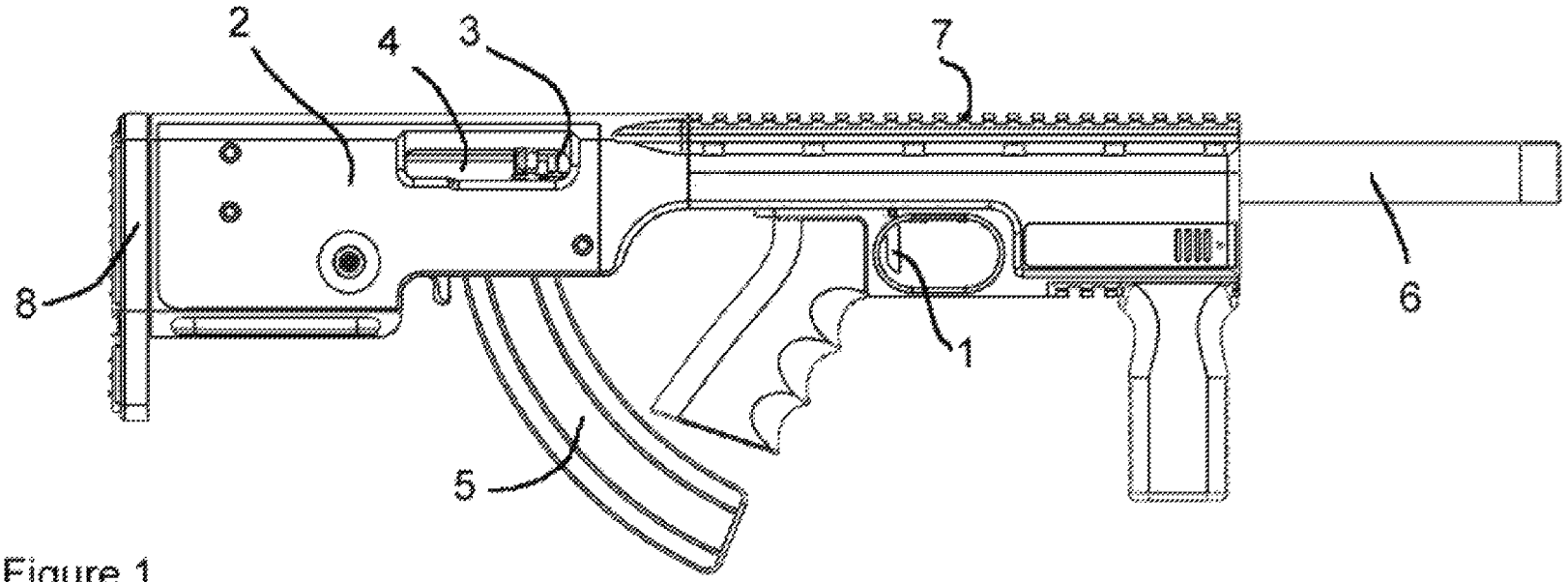
FIG. 1 illustrates a side view of an example embodiment of an ergonomic takedown firearm.

Examples of the invention are shown in the above-identified figures and described in detail below. In describing these examples, similar or identical reference numbers are used to identify similar or identical elements. Throughout this description, position designations such as "forward," "rearward," "above," "below," "top," and "bottom" are referenced to a firearm held in a standard firing position, where the firearm is held with the barrel pointed forward, away from the shooter, in a generally-horizontal orientation.

In the operation of a typical firearm, a shooter applies a mechanical force to a trigger control to fire the firearm. The trigger control is mechanically coupled, directly or through intermediate mechanical transfer linkages, to a sear, which holds the hammer or striker of the firearm in an energized or "cocked" state. Actuation of the trigger control causes the sear to release the hammer or striker, which then allows the hammer or striker to impact the ammunition cartridge primer, either directly or through an intermediate component such as a firing pin. Imperfections in the sear mechanism, such as roughness of mated mechanical surfaces, can cause irregularity of the trigger control pull motion, perceived by the shooter as inconstant or irregular motion during the application of pull force. The addition of intermediate mechanical-domain linkages, which are used in bullpups to allow a forward-mounted trigger control to actuate a rearward-mounted sear, tend to further degrade the quality of the trigger control ergonomics, due to increased length of mechanical components, reduced stiffness of mechanical components, increased number of mechanical joints, and increased friction losses, among other factors.

To improve the ergonomic quality of trigger controls in bullpup firearms, electromechanical systems have been devised, which allow the forward-mounted trigger control to function merely as an electrical switch, initiating the action of a solenoid or other electro-mechanism connected to the rearward-located firing mechanism. Because the firing impetus in these systems is transmitted electrically rather than mechanically, a trigger control of improved ergonomic quality may be implemented without consideration for the effects of a mechanical transmission linkage or the effects of the firing mechanism itself. One patent describing an electromechanical means to improve the ergonomic quality of a bullpup firearm is U.S. Pat. No. 2,337,145. Another patent describing an electromechanical firing mechanism for a bullpup firearm is U.S. Pat. No. 4,727,670. In addition to electrical transmission of the firing signal, other non-mechanical firing transmission signal modalities could include optical signals, magnetic signals, or radio-frequency signals, or a combination thereof.

In the attached figures and in the detailed description that follows, embodiments of a takedown firearm incorporating electrical-domain connectors for the trigger control linkage and bullpup firearm configuration are disclosed. The benefits of a takedown firearm design have, prior to the current invention, not been realized in combination with a bullpup firearm design. This is possibly due to lack of a simple, safe, and reliable means to connect and disconnect the typically-mechanical trigger control linkage between the forward-located trigger control and the rearward-located firing mechanism in a bullpup. By incorporation of an electromechanical type of firing mechanism, the connection and disconnection apparatus required in a takedown design can be implemented in a domain other than the mechanical domain, such as the electrical domain. An electrical connector which bridges the mating surfaces of the rearward assembly and forward assembly of a takedown firearm can allow a forward-mounted trigger control to reliably initiate a rearward-mounted firing mechanism. An electrical-domain linkage simultaneously permits the expedient and reliable assembly and disassembly process that is desirable in a takedown firearm.

In some embodiments, an adjustable stock is incorporated into the bullpup takedown firearm design, improving compactness in the assembled state, and allowing adjustments for user comfort. A benefit of a non-mechanical trigger control linkage, such as an electrical linkage, is that flexible wires can be routed along any convenient geometric path. By comparison, mechanical linkages must transmit tensile or compressive forces along mechanical members with geometric constraints on joint locations and component stiffness, and the mechanical linkage members must have clearances to allow motion. Because electrical wiring can be routed along many geometric paths with equivalent functionality, the designer is less constrained in the layout of the bullpup action, allowing telescoping stock components to be located in volumes that are typically occupied by trigger control linkage components in a bullpup with a mechanical-domain trigger control linkage.

Embodiments of the presently disclosed firearms thus combine features of the bullpup and takedown configurations. Some embodiments of the ergonomic takedown firearm apparatuses described herein provide an electrical-domain linkage apparatus between the forward-mounted trigger control and rearward-mounted firing mechanism of a bullpup firearm. This electrical-domain linkage apparatus uses electrical wires rather than rods, bars, wires, or cables to transfer the firing impetus rearward. Thus, the ergonomically-detrimental trigger control pull properties of mechanical-domain transfer mechanisms typically used in bullpup firearms are eliminated from the described apparatus.

Examples of the presently disclosed takedown firearms include an electrical-domain connection-disconnection apparatus between a forward takedown subassembly and a rearward takedown subassembly of a takedown firearm. An electrical-domain connection-disconnection permits the expedient assembly and disassembly process that is desirable in a takedown firearm. The electrical-domain connection-disconnection apparatus can be implemented as any suitably-reliable electrical connector type, with a mating and unmating process suited to provide reliable electrical connection over many mating and unmating cycles. By contrast, a mechanical linkage requires a mechanical connection-disconnection apparatus tolerant of many mating cycles, with a mating and unmating process suited to provide reliable mechanical connection between the forward takedown subassembly and rearward takedown subassembly.

Some embodiments of the ergonomic takedown firearm apparatuses described herein include an adjustable stock mechanism. This adjustable stock mechanism allows adjustment of the length-of-pull to suit a particular shooter's body characteristics and firing posture. Some of these and some other example ergonomic takedown firearm apparatuses described herein include an adjustable trigger control. This feature allows the user to adjust the trigger control pull ergonomic characteristics, including, for example, length of trigger control travel, pull force, or number of stages. Because the linkage between the trigger control and firing mechanism is in the electrical domain, mechanical changes affecting the ergonomic quality of the adjustable trigger control do not affect the mechanical characteristics of the firing mechanism, such as the friction of the sear-hammer interface, for example. In some embodiments, the ergonomic takedown firearm apparatuses described herein may include a sighting system mount that is coupled to the forward takedown subassembly. Thus, alignment of the sighting system to the barrel bore is maintained during takedown disassembly and reassembly procedures.

FIG. 1 illustrates an example ergonomic takedown firearm apparatus in an assembled state. The firearm is arranged as a bullpup firearm, with a trigger control 1 located forward of the receiver subassembly 2, breech 3, bolt 4, and magazine 5. In this example, the sighting system mount 7 is fixedly coupled to barrel 6, to preserve relative alignment. In this example, an adjustable stock 8 is shown in a collapsed state.

When the user pulls the forward-located trigger control 1, an electronic switch is closed, creating an electrical-domain firing signal. This signal propagates through electronic circuitry of an electrical-domain linkage to reach a firing mechanism located rearward within the receiver subassembly 2. An electromechanical device, such as a solenoid, converts the electrical-domain signal into a mechanical force, causing the firing mechanism to fire.

Figure 2:
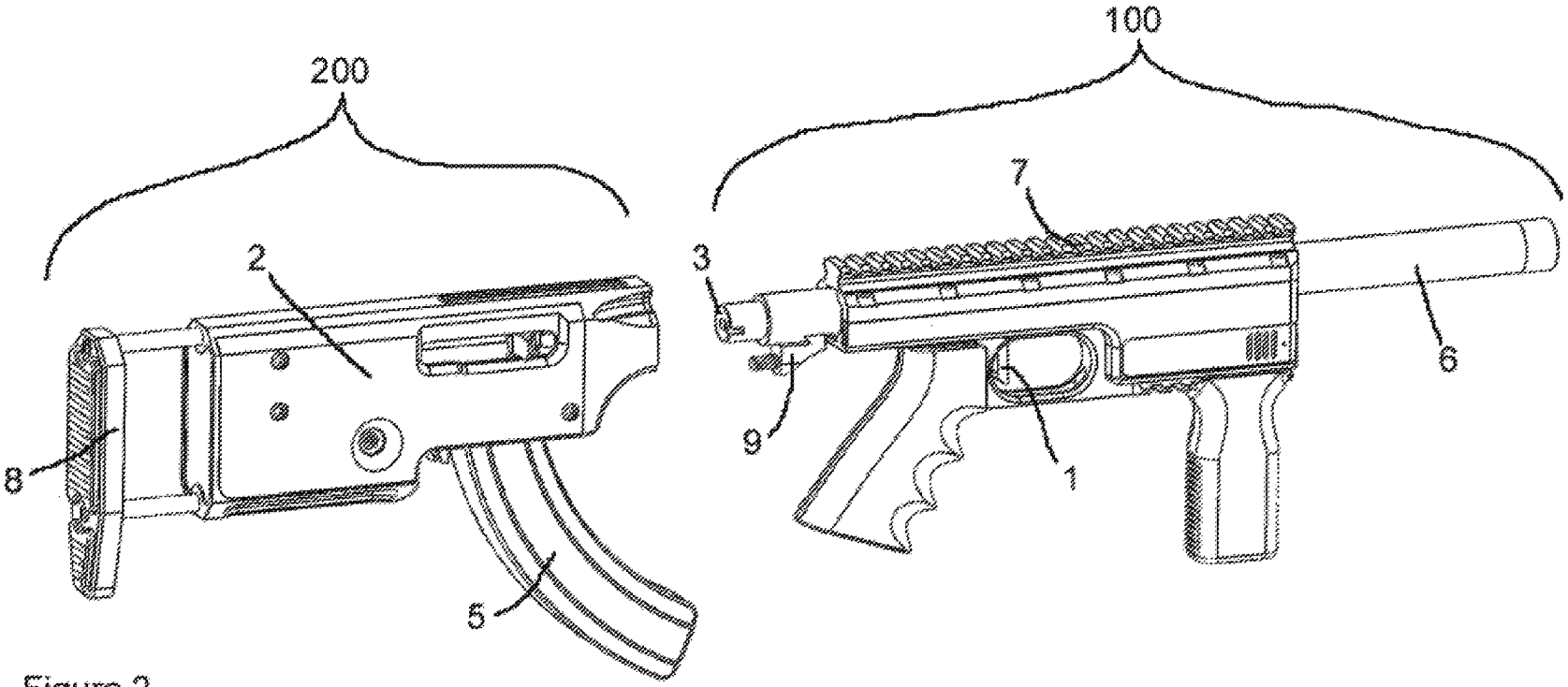
FIG. 2 is a side perspective of the example takedown firearm, in a take-down state.

FIG. 2 illustrates an example ergonomic takedown firearm apparatus in a disassembled state. A forward takedown subassembly 100 is separated from a rearward takedown subassembly 200. A takedown mechanism 9 has been operated to disassemble the firearm. For example, the takedown mechanism may incorporate a hook and threaded bolt, as shown in FIG. 2. The hook latches to a groove cut into the barrel, and the threaded bolt fastens to a threaded hole incorporated into the receiver subassembly 2. The threaded bolt and hook serve to retain the barrel within a stepped cylindrical hole in the receiver. Alternative takedown mechanisms may incorporate a threaded barrel and receiver, a split-ring threaded clamp, a toggle clamp, or a cross-pinned sliding joint, among others. Some of these alternative takedown mechanisms will be described in further detail below.

As illustrated in FIG. 2, the example forward takedown subassembly 100 includes the barrel 6 and sighting system mount 7. Because the mechanical alignment of the barrel and sighting system mount are maintained throughout the disassembly and reassembly process, the point-of-aim indicated by the sighting system (not shown) will remain in alignment with the point-of-impact. This alignment will not depend upon the precision or mechanical mating repeatability of the takedown mechanism, as is the case for takedown firearms with sighting system mounts that are separated from the barrel during takedown.

Figure 3:
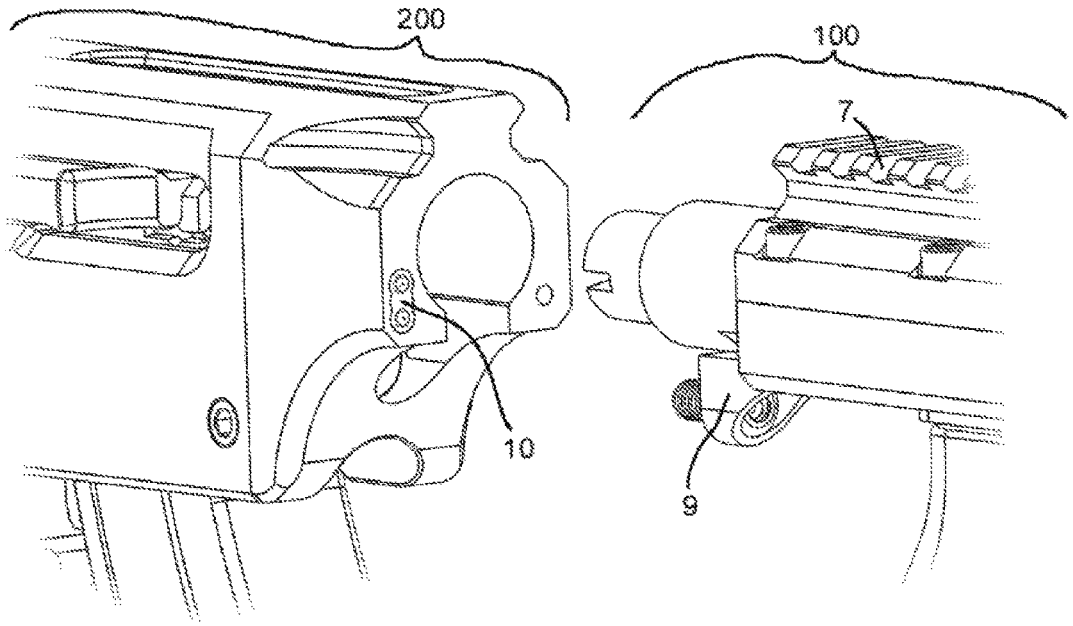
FIG. 3 shows a perspective view of the firing signal connector on the rearward assembly of an example takedown firearm.

FIG. 3 illustrates a detailed view of an example ergonomic takedown firearm apparatus in a disassembled state. In this detailed view, a rearward firing signal connector 10 is shown on a mating surface of the rearward takedown subassembly 200.

Figure 4:
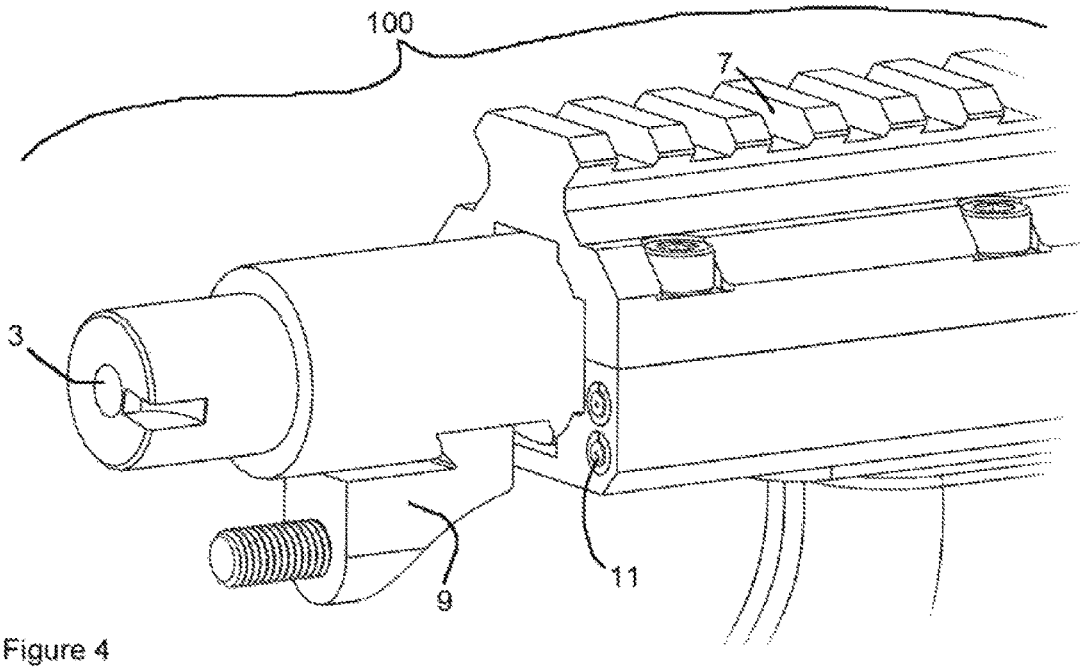
FIG. 4 is a side perspective view of the firing signal connector on the forward assembly of the firearm shown in FIG. 3.

FIG. 4 illustrates a detailed view of an example ergonomic takedown firearm apparatus in a disassembled state. In this detailed view, a forward firing signal connector 11 is shown on a mating surface of the forward takedown subassembly 100.

The firing signal connectors 10 and 11 may be a blind-mate electrical connector. With this approach, one or more conductive pins supported by electrically-insulating mechanically-compliant substrate material are arranged to slightly protrude from a mating surface. When the mating surface of the forward takedown subassembly is brought into close contact with the complementary mating surface of the rearward takedown subassembly, the conductive pins make electrical contact, allowing electrical-domain signals to propagate across the takedown joint when in the assembled state.

Other firing signal connector types may be used, however. Alternative electrical connector types include plug-and-socket connectors, pogo pin connectors, threaded coaxial connectors, terminal block connectors, printed circuit board card-edge connectors, bayonet connectors, RCA connectors, or audio jack-plug connectors, among others. Examples of several of these alternative connector types will be described in detail below.

It is understood that an additional signal domain change, from the electrical signal domain to an optical signal domain, could also be performed. In this case, the electrical-domain connector could alternatively be replaced by a fiber optic or light pipe connector, with a light source such as a light emitting diode on the transmitting side of the connection, and a light receiver such as a photodiode on the receiving side of the connection. A radio-frequency signal could be used to transmit the firing signal from the forward takedown subassembly to the rearward takedown subassembly. Both of these options would require additional components compared to a conductive electrical connector, and could subject the firearm to increased risk of unintended fire as a result of extrinsic interfering signals. However, suitable shielding and coding strategies might be used to reduce this risk to an acceptable level.

Figure 5:
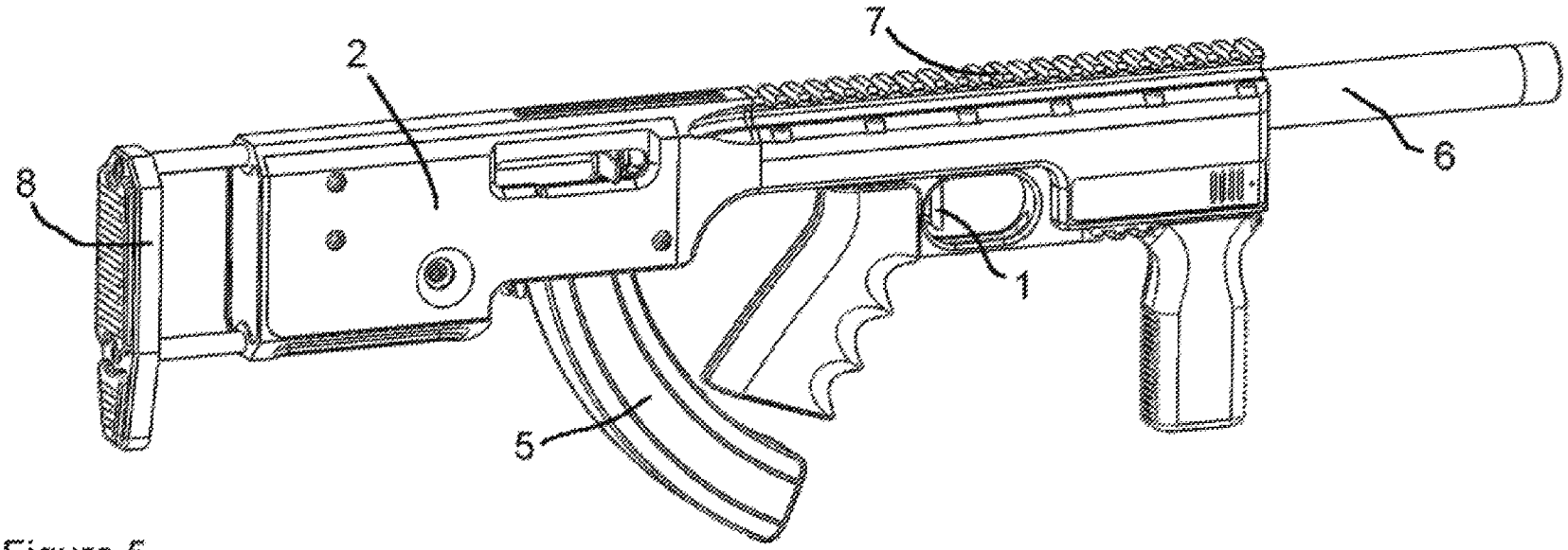
FIG. 5 illustrates a side view of an example takedown firearm with an adjustable stock in an extended state.

FIG. 5 illustrates an example ergonomic takedown firearm apparatus in an assembled state with an adjustable stock 8 in an extended state. In this position, the length-of-pull distance between the trigger control and the surface of the adjustable stock that rests against the shooter's shoulder is arranged to accommodate a comfortable shooting posture for a shooter with longer arms, for example.

In the non-limiting example shown, the adjustable stock 8 is implemented with cylindrical rod supports which slide in and out of cylindrical holes in the receiver subassembly 2, with a clamping mechanism that allows the user to fix the stock at a desired position. The cylindrical rod supports occupy a volume in the receiver subassembly that is often occupied by mechanical linkage components in a typical bullpup. Compared to mechanical-domain linkage types, the non-mechanical linkage and connectors occupy relatively little volume. Because the electrical-domain firing signal can be transmitted via a flexible wire, the firearm designer is free to route the signal from the forward mounted trigger control and electronic circuitry to the rearward-mounted electromechanical device along any convenient path, leaving room for adjustable stock components. By comparison, a mechanical linkage may require a "straight-line" geometric path to operate without binding, leaving the designer with few alternatives for placement of the linkage.

In view of the detailed examples illustrated in FIGS. 1-6 and described above, it will be appreciated that embodiments of the presently disclosed takedown firearms include a forward takedown subassembly comprising a barrel, a breech at a rearward end of the barrel, a trigger control mechanism fixedly coupled to the barrel and configured to provide an electrical trigger control signal responsive to movement of a trigger portion of the trigger control mechanism, and a signal transmitter electrically coupled to the trigger control mechanism and configured to receive the electrical trigger control signal. These takedown firearms further include a rearward takedown subassembly separable from the forward takedown subassembly, the rearward takedown subassembly comprising a stock, a receiver coupled to the stock and comprising an electrically controlled firing mechanism, and a signal receiver having an output electrically coupled to the electrically controlled firing mechanism.

The forward and rearward takedown subassemblies are attachable and detachable from one another, using a takedown mechanism having first and second portions fixedly coupled to the forward takedown subassembly and the rearward takedown subassembly, respectively, and configured to repeatably couple the forward takedown subassembly to the rearward takedown subassembly. The signal transmitter and the signal receiver are configured to link the electrical trigger control signal to the signal receiver output via one or more of an electrical connection, an optical connection, and a radio-frequency link.

Figure 6:
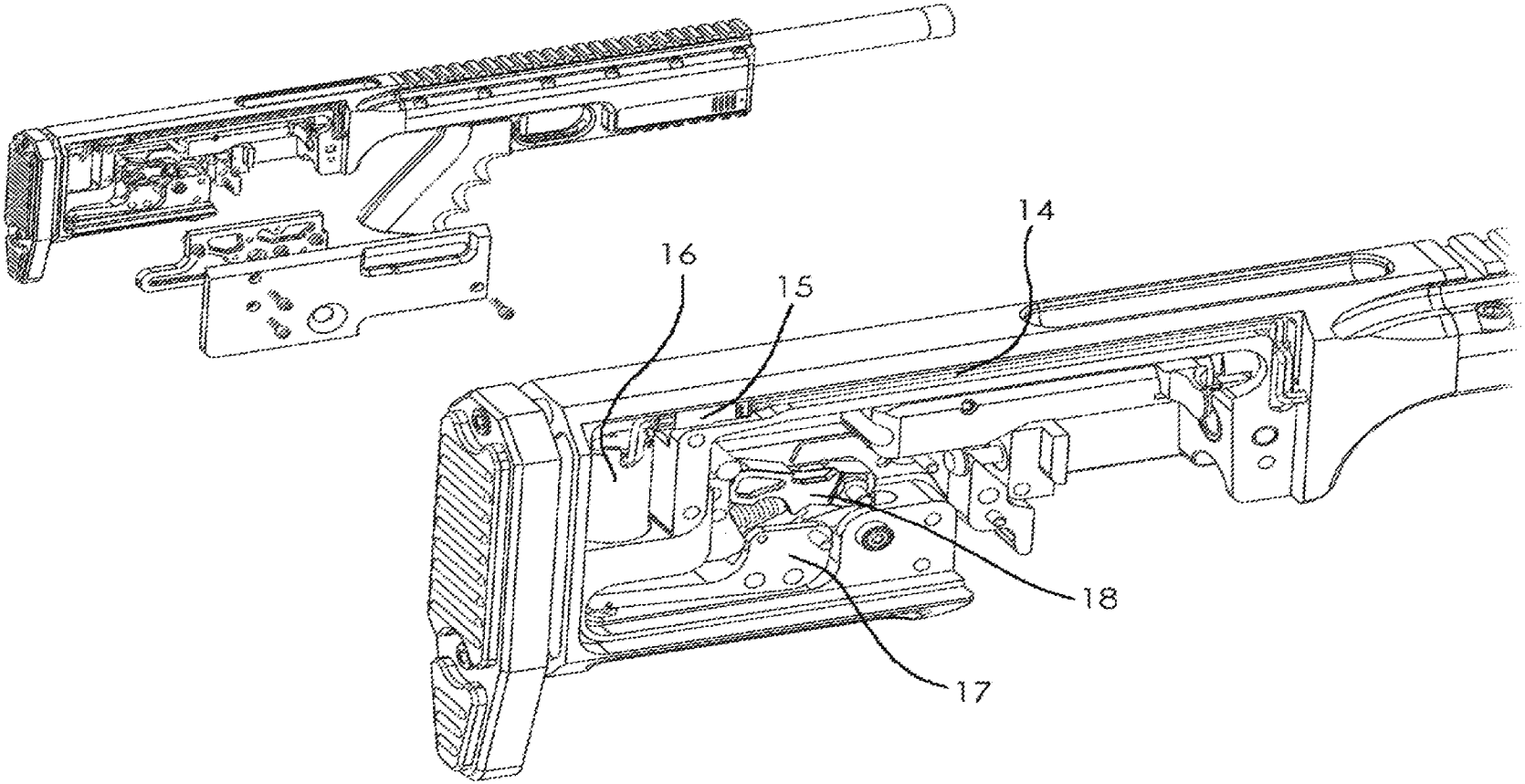
FIG. 6 illustrates details of an example electro-mechanical firing mechanism.

An example firing mechanism is shown in FIG. 6. At the top of the figure, the takedown firearm shown in FIG. 1 is illustrated with covers removed from the receiver subassembly 2. The lower part of the figure illustrates details of an example electro-mechanical firing mechanism, which includes wires 14 extending from the electrical connector at the forward end of the rearward takedown subassembly to an in-line connector 15, and a solenoid 16 electrically connected to in-line connector 15 and configured to control a lever 17, which in turn releases hammer 18. It will be appreciated that other configurations of the firing mechanism are possible.

As noted above, in some embodiments, the takedown firearms described herein may comprise an adjustable stock as illustrated, for example in FIG. 5. In some embodiments, the forward takedown subassembly further comprises a sighting system mount fixedly coupled to the barrel, so as to preserve alignment of the sighting system mount and barrel during disassembly and reassembly of the firearm apparatus. This is also shown in FIG. 5, where sighting system mount 7 is fixedly coupled to the barrel 6.

Figure 7:
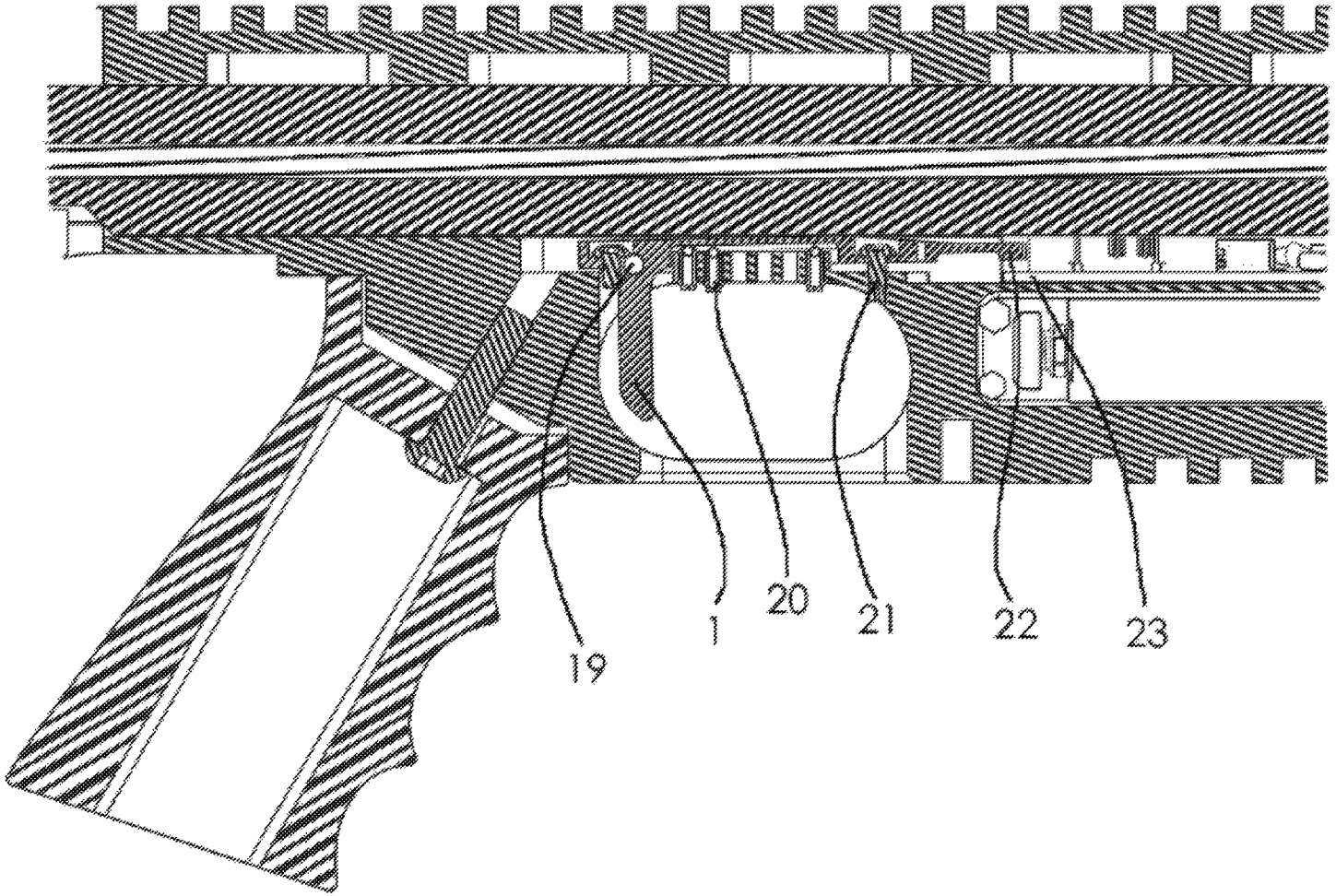
FIG. 7 is a cross-section view of an example firearm, illustrating details of an example trigger mechanism.

FIG. 7 is a cross-sectional diagram of an example trigger control mechanism. The illustrated trigger control mechanism comprises a trigger 1, a trigger pivot pin 19, a trigger travel adjustment screw 21, a trigger electrical contact tip 22, and a printed circuit board 23, which carries circuitry to detect the trigger-activated contacting of contact tip 22 as well as an electrical transmitter circuit, for forwarding to the firing mechanism in the rearward takedown subassembly. Printed circuit board 23 may carry some conditioning circuitry for conditioning the triggering signal, in some embodiments. In some embodiments, including in the illustrated example, the trigger control mechanism may comprise a trigger having an adjustable trigger pull force. This adjustable trigger pull force may be provided, for example, with one or more spring-loaded ball-nosed plungers 20, as shown in FIG. 7. This spring-loaded ball-nosed plunger 20 is mounted in a threaded hole, such that the pull force may be adjusted by adjusting the depth of the plunger 20 in the threaded hole. Trigger pull force may be additionally adjusted by adding or removing spring plungers at locations nearer to or more distant from the pivot pin. Similarly, the trigger travel distance may be adjusted, in some embodiments, by adjusting the threaded depth of trigger travel adjustment screw 21. The head of trigger travel adjustment screw 21 makes contact with the horizontal body of the trigger 1, when the trigger is pulled, limiting its travel.

Figure 8:
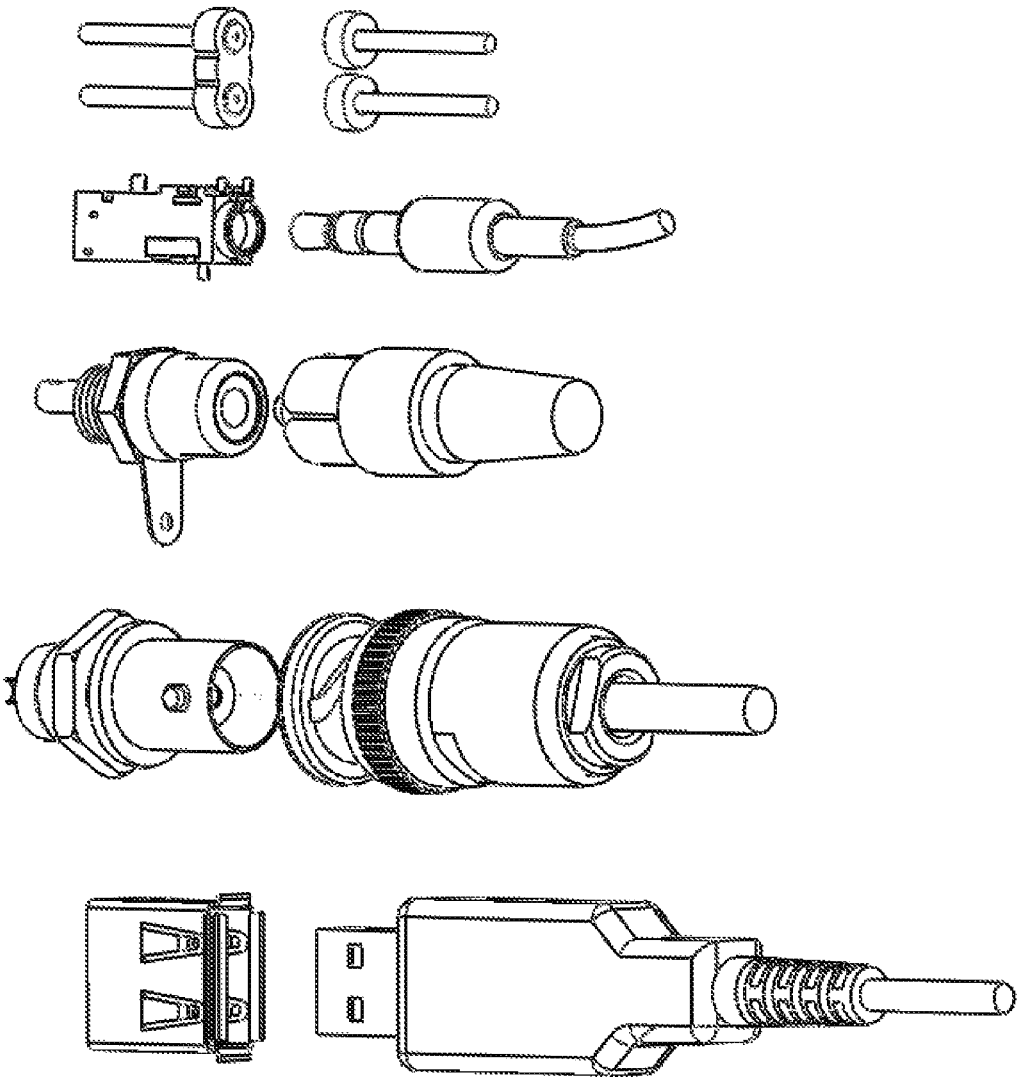
FIG. 8 illustrates several alternative electrical connectors.
Figure 10:
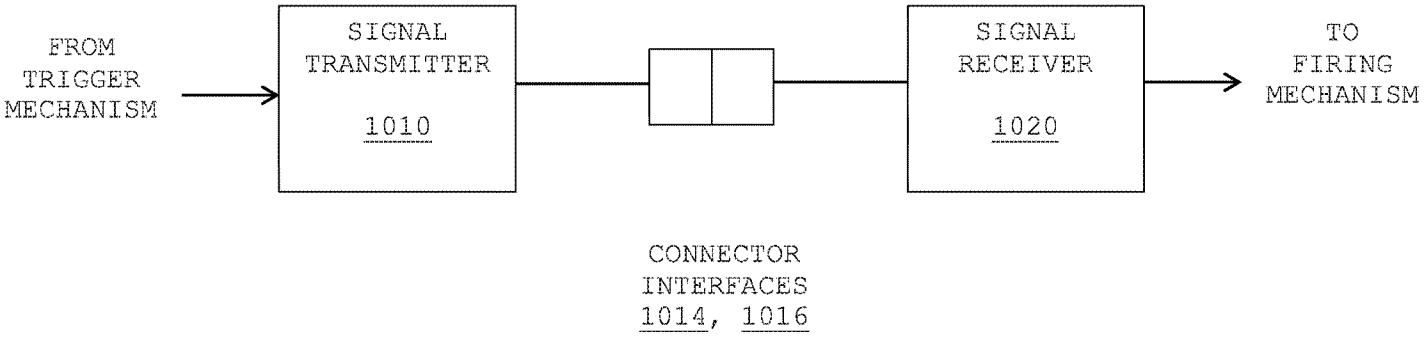
FIG. 10 is a schematic diagram illustrating an electrical link between forward and rearward takedown subassemblies.

As discussed above, the takedown firearm includes circuitry in the forward takedown subassembly for detecting a trigger pull and for transmitting a trigger signal to the rearward takedown subassembly. The rearward takedown subassembly correspondingly includes circuitry for receiving the trigger signal and converting it to the firing action, e.g., via the solenoid illustrated in FIG. 6. The former circuitry may be referred to as a signal transmitter, while the latter is referred to a signal receiver. An example is shown in the schematic diagram of FIG. 10, which illustrates an embodiment in which a signal transmitter 1010 and signal receiver 1020 are configured to link the electrical trigger control signal to the signal receiver output via an entirely electrical connection, where the forward takedown subassembly is coupled to the rearward takedown subassembly by the takedown mechanism, via first and second electrical connector interfaces 1014 and 1016 that are electrically coupled to the signal transmitter 1010 and signal receiver 1020, respectively. These connector interfaces 1014, 1016 may comprise one or more of any of several types, including the example types illustrated in FIG. 8, from top to bottom: blind-mating conductive pins; mating audio plugs and jacks; mating RCA plugs and jacks; bayonet connectors (BNC); and other mating electrical plug and socket such as the illustrated USB connector interfaces. Other possibilities include printed-circuit-board card-edge connectors, for example.

Figure 11:
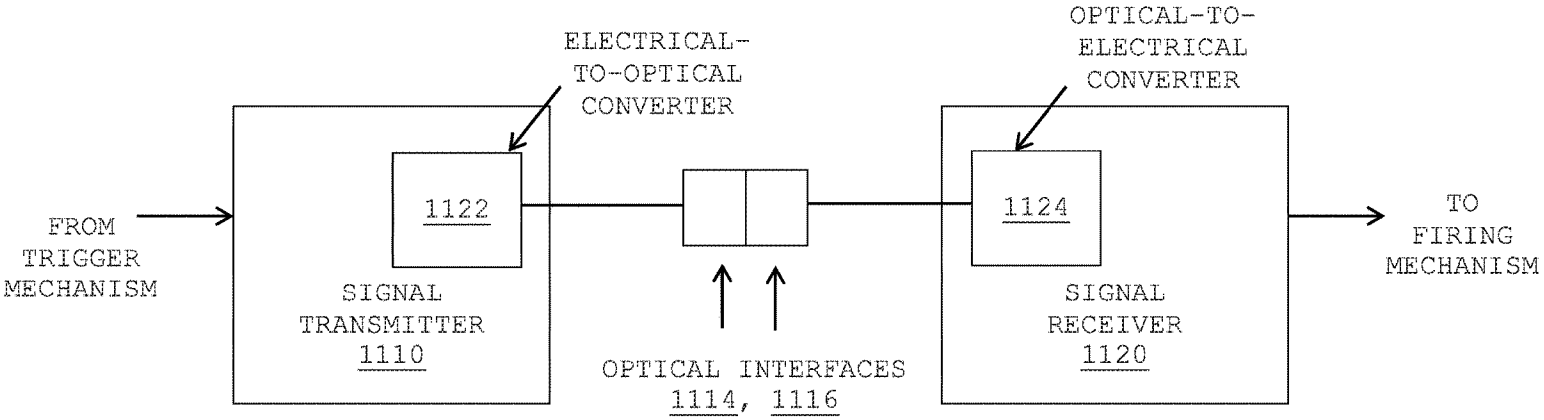
FIG. 11 is a schematic diagram illustrating an optical link between forward and rearward takedown subassemblies.

In some embodiments, the link between the forward and rearward takedown subassemblies includes an optical link. An example schematic is shown in FIG. 11, where the signal transmitter 1110 and the signal receiver 1120 comprise an optical output from electrical-to-optical converter 1122 and an optical input to optical-to-electrical converter 1124, respectively, and the forward takedown subassembly and rearward takedown subassembly comprise first and second optical interfaces 1114 and 1116, respectively. The first and second optical interfaces 1114, 1116 are optically coupled to the signal transmitter 1110 and signal receiver 1120, respectively, and configured to optically connect the signal transmitter to the signal receiver when the forward takedown subassembly is coupled to the rearward takedown subassembly by the takedown mechanism.

Figure 12:
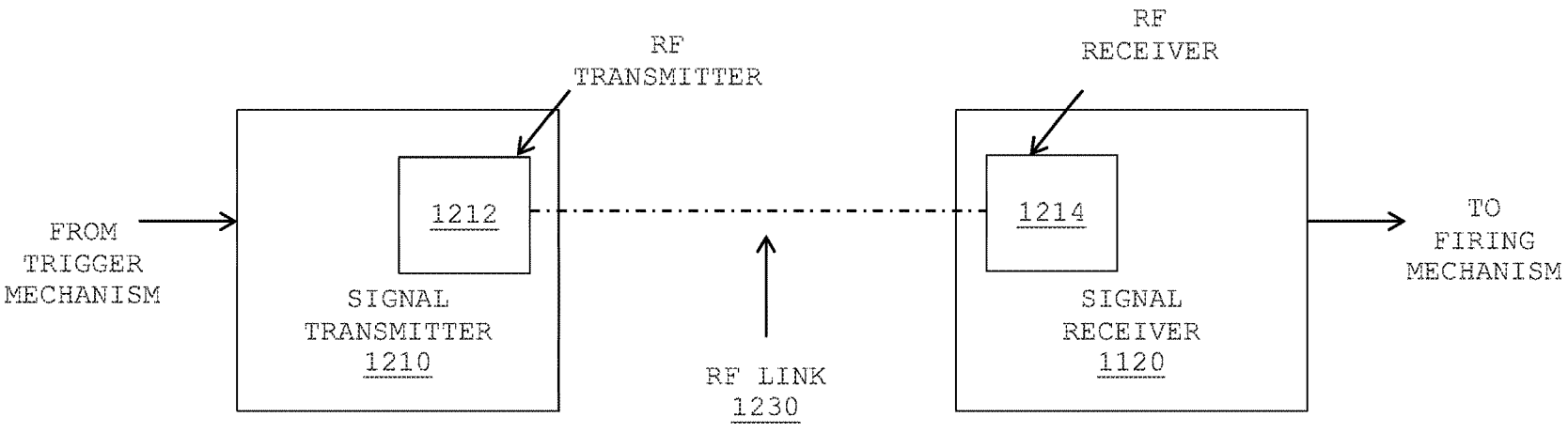
FIG. 12 is a schematic diagram illustrating a radio-frequency (RF) link between forward and rearward takedown subassemblies.

In still other embodiments, an example of which is illustrated in FIG. 12, a signal transmitter 1210 and signal receiver 1220 comprise a radio-frequency transmitter 1212 and radio-frequency receiver 1214, respectively. The radio-frequency transmitter 1212 and radio-frequency receiver 1214 are configured to link the electrical trigger control signal to the signal receiver output via a radio-frequency (RF) link 1230.

Figure 9:
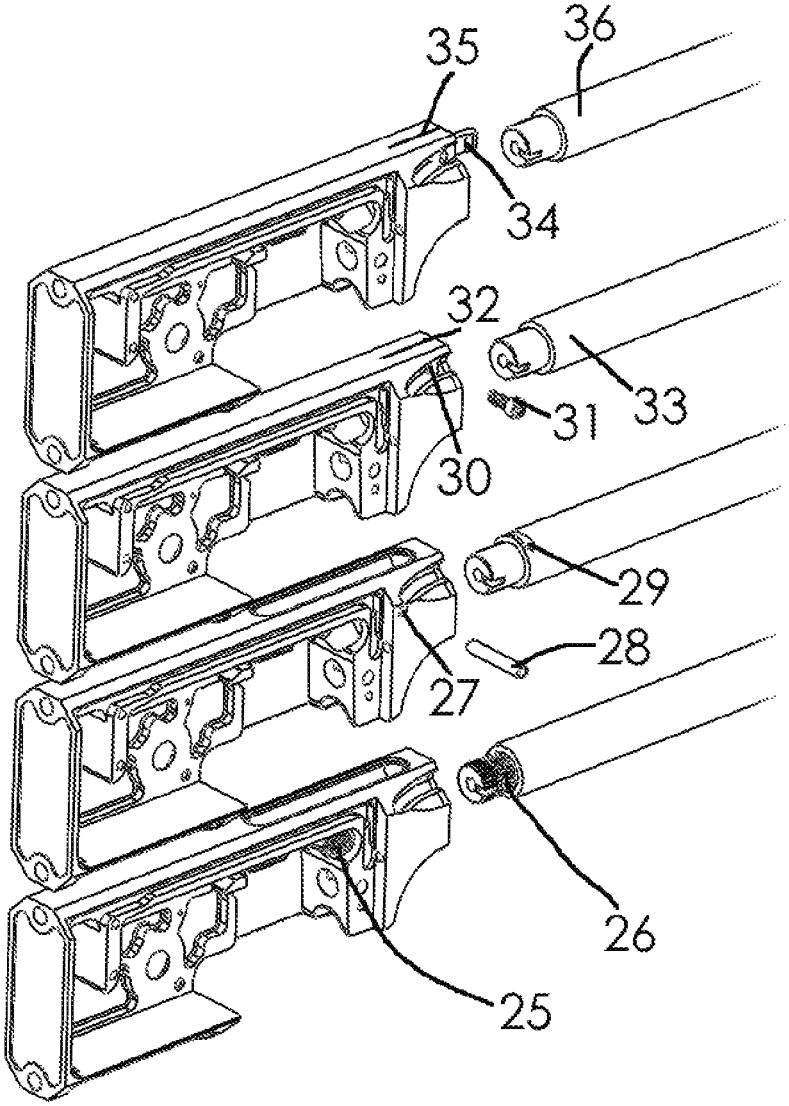
FIG. 9 shows several example takedown mechanisms.

The specific design of the takedown mechanism may vary from that shown in FIGS. 3 and 4, in various embodiments of the takedown firearm. In those figures, the takedown mechanism includes a hook mechanism 9 securely coupled to the barrel, a threaded hole or insert in the receiver, and a threaded bolt configured to engage with the hook mechanism and to thread into the threaded hole or insert. Other examples are shown in FIG. 9 and include, from top to bottom: a takedown mechanism that includes a toggle claim comprising a toggle lever 34, a clamp slit 35, and a barrel clamping surface 36; a takedown mechanism that includes a split-ring threaded claim comprising a tapped hole 30, a threaded bolt 31, a clamp slit 32, and a barrel clamping surface 33; a takedown mechanism that includes a cross-pinned sliding joint comprising a cross-pin 28, cross-drilled receiver hole 27, and cross-drilled barrel slot 29; and a takedown mechanism that includes exterior threads 26 at the rearward end of the barrel and a corresponding threaded hole or insert 25 in the receiver.

It will be appreciated that the attached figures and detailed examples above provide methods and apparatuses for providing an accurate and ergonomic firearm with a short overall length and improved storage compactness is disclosed. While the invention has been described with reference to several exemplary embodiments, it will be understood by those skilled in the art that various changes may be made and equivalents substituted for elements thereof without departing from the scope of the invention. Therefore, it is intended that the invention may not be limited to one particular embodiment, but that the invention will include all embodiments falling within the scope of the present application.

What is claimed is:

1. A firearm apparatus comprising:

a forward takedown subassembly comprising a barrel, a breech at a rearward end of the barrel, a trigger control mechanism fixedly coupled to the barrel and configured to provide an electrical trigger control signal responsive to movement of a trigger portion of the trigger control mechanism, and a signal transmitter electrically coupled to the trigger control mechanism and configured to receive the electrical trigger control signal;

a rearward takedown subassembly separable from the forward takedown subassembly, the rearward takedown subassembly comprising a stock, a receiver coupled to the stock and comprising an electrically controlled firing mechanism, and a signal receiver having an output electrically coupled to the electrically controlled firing mechanism; and a takedown mechanism having first and second portions fixedly coupled to the forward takedown subassembly and the rearward takedown subassembly, respectively, and configured to repeatably couple the forward takedown subassembly to the rearward takedown subassembly so as to mate the breech of the forward takedown subassembly with the receiver of the rearward takedown subassembly;

wherein the signal transmitter and the signal receiver are configured to link the electrical trigger control signal to the signal receiver output via one or more of an electrical connection, an optical connection, and a radio-frequency link.

2. The firearm apparatus of claim 1, wherein the stock is an adjustable, telescoping stock.

3. The firearm apparatus of claim 1, wherein the forward takedown subassembly further comprises a sighting system mount fixedly coupled to the barrel, so as to preserve alignment of the sighting system mount and barrel during disassembly and reassembly of the firearm apparatus.

4. The firearm apparatus of claim 1, wherein the trigger control mechanism comprises a trigger having an adjustable trigger pull force.

5. The firearm apparatus of claim 1, wherein the trigger control mechanism comprises a trigger having an adjustable trigger control travel distance.

6. The firearm apparatus of claim 1, wherein the signal transmitter and the signal receiver are configured to link the electrical trigger control signal to the signal receiver output via an electrical connection, and wherein the forward takedown subassembly and rearward takedown subassembly comprise first and second electrical connector interfaces, respectively, the first and second electrical connector interfaces being electrically coupled to the signal transmitter and signal receiver, respectively, and configured to electrically connect the signal transmitter to the signal receiver when the forward takedown subassembly is coupled to the rearward takedown subassembly by the takedown mechanism.

7. The firearm apparatus of claim 6, wherein the first and second electrical connector interfaces comprise one or more of the following:

blind-mating conductive pins;
a mating electrical plug and socket;
printed-circuit-board card-edge connectors;
one or more bayonet connectors;
one or more mating audio plugs and jacks; and
one or more mating RCA plugs and jacks.

8. The firearm apparatus of claim 1, wherein the signal transmitter and the signal receiver comprise an optical output and optical input, respectively, and wherein the forward takedown subassembly and rearward takedown subassembly comprise first and second optical interfaces, respectively, the first and second optical interfaces being optically coupled to the signal transmitter and signal receiver, respectively, and configured to optically connect the signal transmitter to the signal receiver when the forward takedown subassembly is coupled to the rearward takedown subassembly by the takedown mechanism.

9. The firearm apparatus of claim 1, wherein the signal transmitter and the signal receiver comprise a radio-frequency transmitter and radio-frequency receiver, respectively, and wherein the radio-frequency transmitter and radio-frequency receiver are configured to link the electrical trigger control signal to the signal receiver output via a radio-frequency link.

10. The firearm apparatus of claim 1, wherein the takedown mechanism comprises one or more of the following:

a hook mechanism securely coupled to the barrel, a threaded hole or insert in the receiver, and a threaded bolt configured to engage with the hook mechanism and to thread into the threaded hole or insert;

exterior threads at the rearward end of the barrel and a corresponding threaded hole or insert in the receiver;

a split-ring threaded clamp;

a toggle clamp; and a cross-pinned sliding joint.

* * * * *